US007839203B1

(12) United States Patent
MacLean et al.

(10) Patent No.: US 7,839,203 B1
(45) Date of Patent: Nov. 23, 2010

(54) ADAPTIVE CAPACITOR CHARGE/DISCHARGE NETWORK

(75) Inventors: William MacLean, Tucson, AZ (US); Paul David Ranucci, Tucson, AZ (US)

(73) Assignee: National Semiconductor Corporation, Santa Clara, CA (US)

( * ) Notice: Subject to any disclaimer, the term of this patent is extended or adjusted under 35 U.S.C. 154(b) by 0 days.

(21) Appl. No.: 11/042,364

(22) Filed: Jan. 24, 2005

(51) Int. Cl.
*G05F 1/10* (2006.01)

(52) U.S. Cl. ..... 327/540

(58) Field of Classification Search ..... 327/157, 327/538, 540, 541, 543
See application file for complete search history.

(56) References Cited

U.S. PATENT DOCUMENTS 6,031,366 A * 2/2000 Mitsuishi ..... 323/315
6,043,715 A * 3/2000 Bailey et al. ..... 331/2
6,466,070 B1 * 10/2002 Ross ..... 327/157
6,710,666 B1 * 3/2004 Wu et al. ..... 331/17
6,897,692 B1 * 5/2005 Hughes ..... 327/157
7,015,735 B2 * 3/2006 Kimura et al. ..... 327/157
2003/0107420 A1 * 6/2003 Hsu et al. ..... 327/157
2004/0124910 A1 * 7/2004 Chuang et al. ..... 327/541
2005/0068074 A1 * 3/2005 Yahagi et al. ..... 327/157

* cited by examiner

*Primary Examiner*—Lincoln Donovan
*Assistant Examiner*—Khareem E Almo

(57) ABSTRACT

An adaptive capacitor charge/discharge network tailors the rate-of-change of a capacitor. The network includes two circuit groups with two or more parallel circuit branches, each branch including a current source and a controllable switch connected in series. The parallel circuit branches of one group are connected to Vss, and the parallel circuit branches of the other group are connected to Vdd. All the parallel circuit branches are connected to one plate of a capacitor, the other plate of the capacitor is connected to either Vss or Vdd. A control circuit controls the switch status, and incrementally controls the charge/discharge of the capacitor according to a predetermined order and a predetermined timing sequence to achieve a desired tailored charge/discharge curve.

22 Claims, 7 Drawing Sheets

| Table I: Expressions for points in Figures 3A, 3B and 3C | | | |
|---|---|---|---|
| Qmin = | Cmin * Vrefmin | E0 = | Delay * I1 / Qmin |
| Q1 = | I1 *t1 | E1 = | Delay * I2 / Q1 |
| Q2 = | I2 *( t2-t1) + I1 *t1 | E2 = | Delay * I3 / Q2 |
| Q3 = | I3 *( t3-t2) + I2 *( t2 - t1 ) + I1 *t1 | E3 = | Delay * I4 / Q3 |
| Q4 = | I4 *( t4-t3) + I3 *( t3 - t2 ) + I2 *( t2 - t1 ) + I1 *t1 | E4 = | Delay * I5 / Q4 |

Figure 4

| Table II: Design for Equal Worst-Case Error Given Constant Delay Times | |
|---|---|
| Worst Case Error = | (Comp Delay * I1 ) / ( Cmin * Vmin ) |
| I2 / I1 = | ( T1 * I1 ) / ( Cmin * Vmin ) |
| I5 / I4 = I4 / I3 = I3 / I2 = | 1 + I2 / I1 |

Figure 5

ADAPTIVE CAPACITOR CHARGE/DISCHARGE NETWORK

FIELD OF INVENTION

The present invention relates to electrical circuits which charge or discharge a capacitor and, in particular, to an adaptive network that tailors the charge/discharge rate of a capacitor over a range of pre-selected voltages.

BACKGROUND

Techniques for charging or discharging a capacitor include open-loop switches and various types of linear buffers. A simple series circuit composed of a voltage source, switch and capacitor will cause the capacitor to charge when the switch is closed. An open-loop switch diverts current from more useful parts of the circuit. Further, an open-loop switch is limited by the source impedance of the voltage reference node in combination with the impedance of the switch itself. For particularly large values of resistance and/or capacitance, an open-loop switch charge/discharge system can have an RC time constant which may be too long. Connecting a simple switch between the two nodes is limited to configurations where the RC delay created by the reference source impedance in combination with the capacitor's impedance is small, and where it is acceptable to draw current from the reference node.

Using a linear buffer to drive a capacitor to a particular voltage eliminates an overshoot error, however, an error due to offset in the buffer still exists. Linear buffers require a power output stage or large quiescent current for applications requiring charging a large capacitor quickly. For linear buffers using more than one gain stage it is difficult to compensate for a large range of output capacitor values. A linear buffer with high quiescent current is typically unacceptable in a circuit functioning only during error conditions. Further, a linear buffer is not suitable for operation near the supply rail voltages, because most buffers lose gain near the supply rails.

BRIEF DESCRIPTION OF THE DRAWINGS

FIG. 4 depicts Table I, which presents mathematical expressions for selected points of the graphical illustrations of FIGS. 3A-3C FIG. 5 depicts Table II, which presents the constraining equations for the worst-case error.

DETAILED DESCRIPTION OF THE ILLUSTRATIVE EMBODIMENTS

By way of overview and introduction, an adaptive capacitor charge/discharge network is presented. The adaptive capacitor charge/discharge network includes a switched network for charging/discharging a capacitor and a control block that digitally controls the switched network to achieve charge and discharge operations quickly, efficiently and with minimal error in capacitor voltages. The adaptive capacitor charge/discharge network controls the capacitor voltage level, and the voltage rate-of-change, as a function of time by altering the switch states. Thus, the capacitor's charge/discharge current flow is tailored to a desired waveform.

Figure 1A:
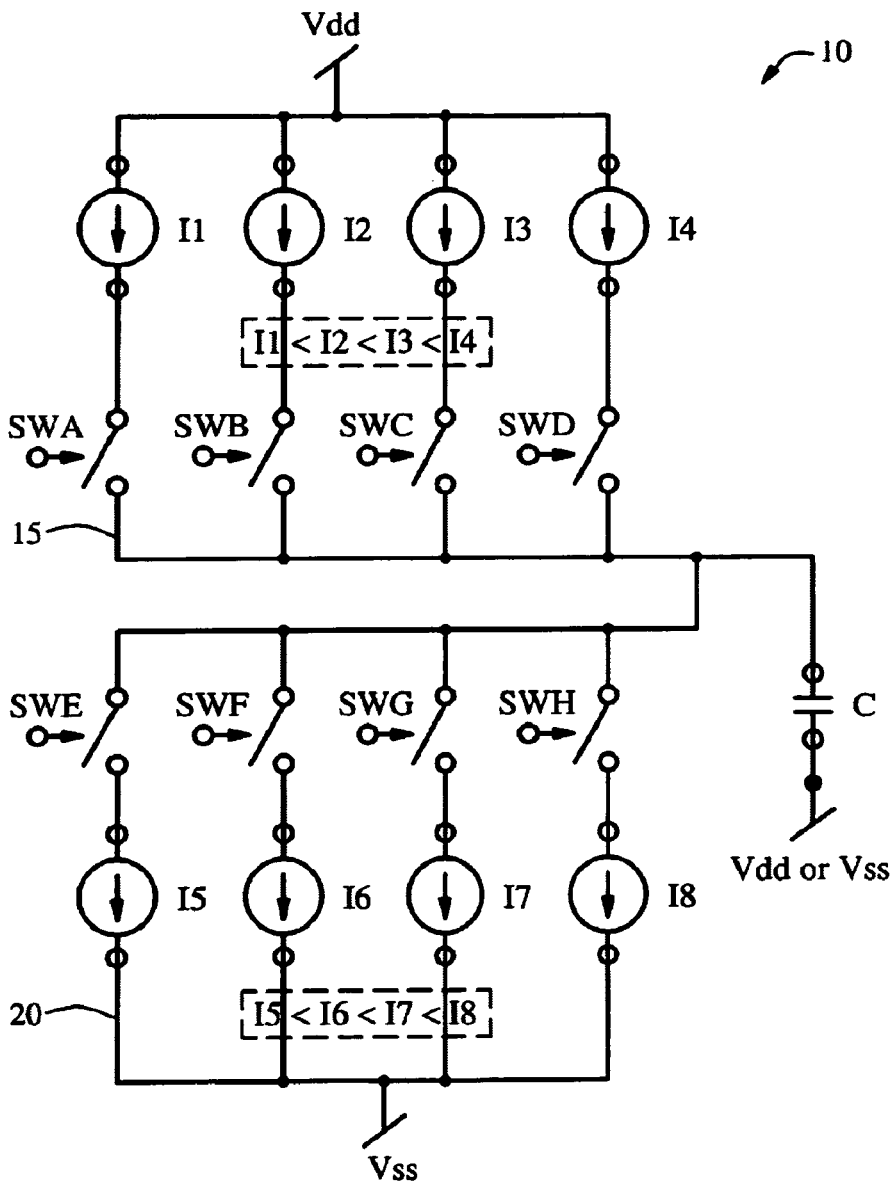
FIG. 1A illustrates a schematic diagram of an embodiment of a capacitor adaptive charge/discharge network.

With reference to FIG. 1A, a schematic diagram of an embodiment of a capacitor adaptive charge/discharge network is illustrated. The adaptive capacitor charge/discharge network 10 is configured with first and second groups 15, 20 of multiple circuit branches. Within each group, the circuit branches are arranged in parallel, and include a current source I1-I8 connected in series with a switch SWA-SWH. The term "current source" has the meaning of a fabricated constant current source, a transistor-biased current source, a current-limiting resistor, a circuit replaceable with a Norton equivalent circuit, or other forms of current sources or current limiters, as is known in the art.

Within each group of circuit branches, each branch has a first terminal commonly connected with a first terminal of each other circuit branch of the group and to either Vdd or Vss, where Vdd is a voltage source that is at a higher potential than voltage source Vss. A second terminal of each branch within the circuit group is commonly connected with a second terminal of each other circuit branch of the group and to a first plate of a capacitor C. The second plate of the capacitor C is connected to either Vdd or Vss.

If the second plate of capacitor C is terminated at Vss, current sources I1-I4 charge the capacitor when respective switches SWA-SWD are closed. The capacitor is discharged through current sources I5-I8 when respective switches SWE-SWH are closed. If the capacitor C is terminated at Vdd, current sources I5-I8 charge the capacitor and current sources I1-I4 discharge the capacitor. Where applicable, the remaining discussion relates to the configuration where the second plate of the capacitor is terminated at Vss.

Figure 1B:
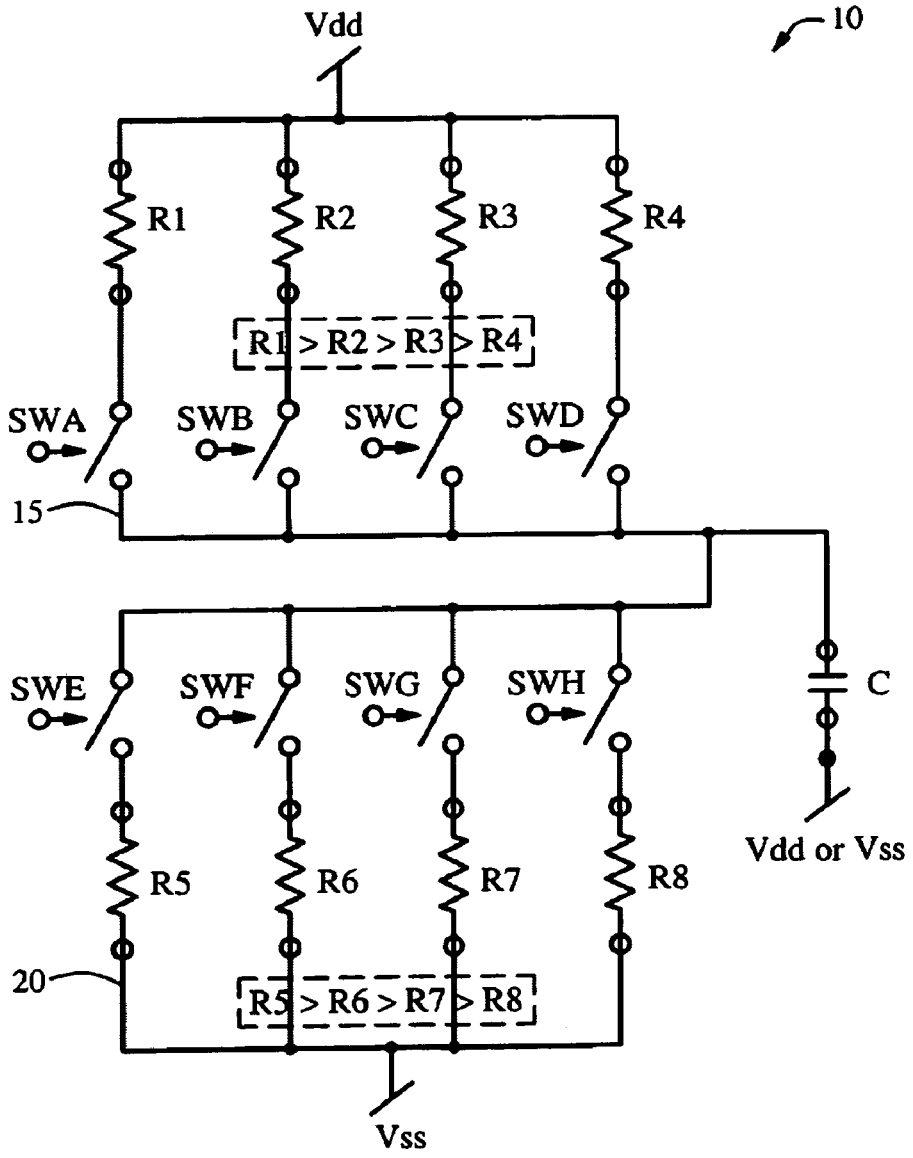
FIG. 1 B illustrates a schematic diagram of another embodiment of a capacitor adaptive charge/discharge network.

FIG. 1B illustrates a schematic diagram of another embodiment of a capacitor adaptive charge/discharge network. In this embodiment the adaptive capacitor charge/discharge network 10 is configured with first and second groups 15, 20 of multiple circuit branches. Within each group, the circuit branches are arranged in parallel, and include a resistor R1-R8 connected in series with a switch SWA-SWH. This embodiment, where current sources have been replaced with resistors in series with the switches, can have application where it is required to charge/discharge the capacitor C to voltages near the supply rail voltages (Vss, Vdd), and exponential charging rates are acceptable.

Although FIGS. 1A and 1B illustrate embodiments of a capacitor adaptive charge/discharge network having four multiple circuit branches within each of the first and second groups, the invention is not so limited. As is readily apparent to a person of ordinary skill in the art, embodiments with other numbers of multiple circuit branches are within the scope of the invention. Additionally, embodiments having a differing number of multiple circuit branches between groups 15, 20 is also within the scope of the invention. Further, the juxtaposition of current sources and switches within the series connected circuit branch does not affect the operation of the circuit, and is within the contemplation of the present invention.

With reference to FIG. 1A, current source I1 supplies less current than current source I2, which supplies less current than current source I3, which in turn supplies less current than current source I4. Similarly, the current supplied by current source I5<I6<I7<I8. As illustrated in FIG. 1B, the resistance of resistor R1>R2>R3>R4, and the resistance of resistor R5>R6>R7>R8. Therefore, as decreasing values of resistance are switched into the circuit, there is a corresponding increase in current flow through each of the respective multiple branches. The arrangement and magnitude of the current sources, or resistors, shape the charging rate for capacitor C. Switches SWA-SWD are activated in sequence when the capacitor C requires charging, while switches SWE-SWH are activated in sequence when the capacitor requires discharging. The switches are controlled by circuit logic and timers such that switch SWA closes before switch SWB, which closes before switch SWC, etc. The following discussion describes the sequence of switching for the embodiment of FIG. 1A.

Figure 2:
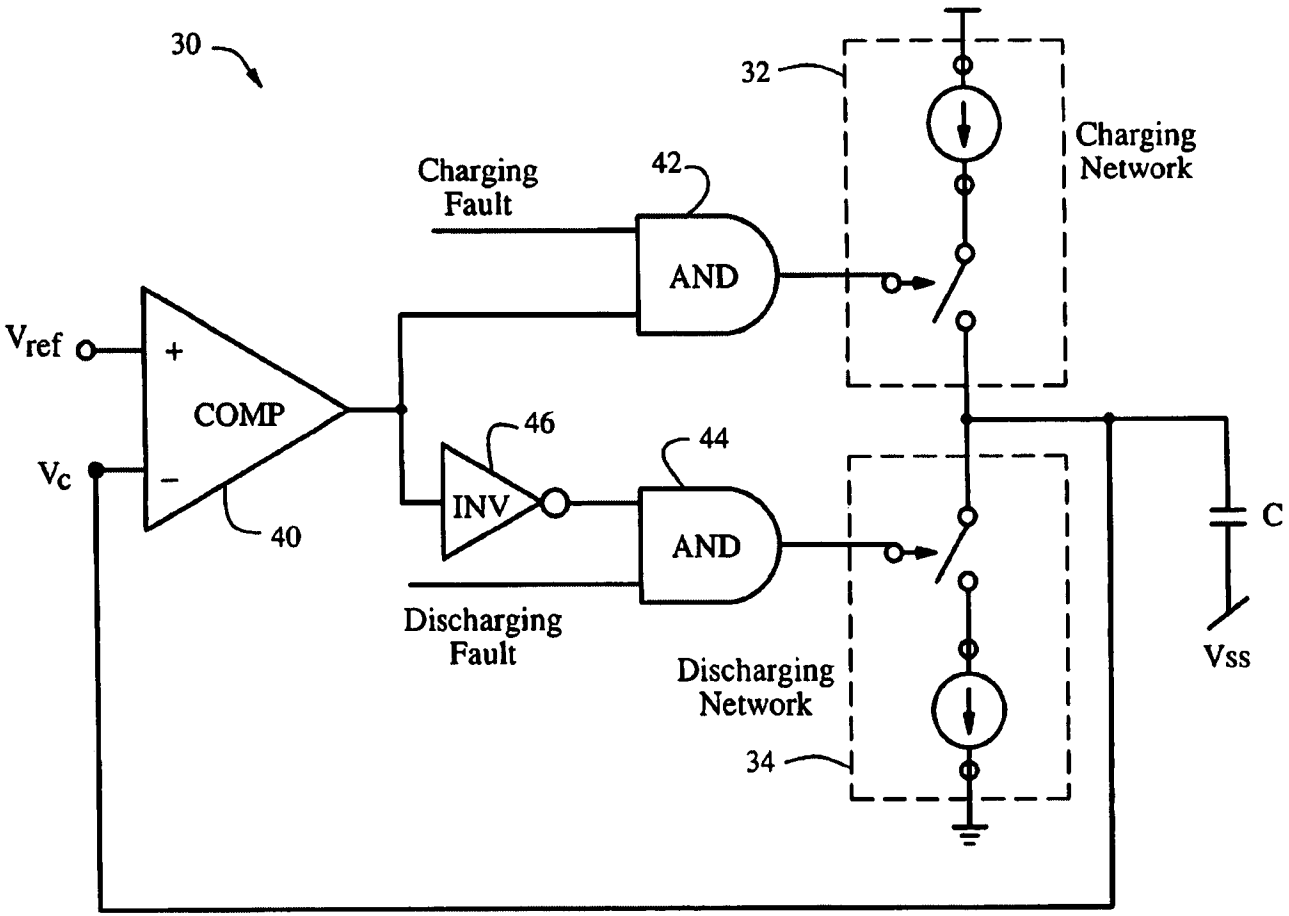
FIG. 2 illustrates a schematic diagram of an embodiment of control circuitry for the networks of FIGS. 1A and 1 B.

FIG. 2 illustrates a schematic diagram of an embodiment of control circuit 30 for the networks of FIGS. 1A and 1B. The invention is not limited to the control circuitry described below. As will be clear to a person of ordinary skill in the art, other configurations of logic circuitry are able to achieve the control of the adaptive capacitor charge/discharge network 10. The control circuit 30, depicted in FIG. 2, represents the operation of the adaptive capacitor charge/discharge network 10 if it is triggered by a digital fault signal. The set of switches and current sources, or resistors, from FIGS. 1A and 1B are represented in FIG. 2 by charging network 32 and discharging network 34, which themselves include a single current source and switch. A voltage reference Vref is supplied to the non-inverting input of comparator 40. The inverting input of comparator 40 is connected to the first plate of capacitor C. When the capacitor voltage Vc charges to Vref, the comparator controls the closure of the charge or discharge branch switches. Additionally, comparator 40 keeps the capacitor C from charging if Vc is already above the reference voltage. The source of Vref (not shown) is adjustable and settable based on predetermined parameters that control the desired voltage to which capacitor C will be charged. This configuration can have application in systems where error checking for the fault signal is required. The output of comparator 40 is connected to logic circuitry composed of an AND gate 42, and an inverter 46 connected in series with a second AND gate 44.

The AND gate 42 processes the comparator output with a charging fault indicator signal. The output of AND gate 42 is connected to the switch of charging network 32. The AND gate 42 activates the charging network switch only if a charging fault occurs and the capacitor voltage is below the reference voltage. Similarly, the AND gate 44 process the inverted comparator output with a discharging fault indicator signal. The output of AND gate 44 is connected to the switch of discharging network 34. The AND gate 44 activates the discharging network switch only if a discharging fault occurs and the capacitor voltage is higher than the reference voltage. Once the desired threshold has been reached, the control circuit 30 turns off all of the switches, even if the fault is still occurring. This keeps the bias current of the adaptive capacitor charge/discharge network 10 low. Thus, adaptive capacitor charge/discharge network 10 is a power load only when the circuit is actually charging or discharging the capacitor. Additionally, with an inherently low quiescent current the adaptive capacitor charge/discharge network 10, and the control circuit 30 can be made to go into a standby mode (i.e., low power consumption) when it is not needed.

In the embodiments of FIGS. 1A and 1B, the single switch and current source of FIG. 2 are replaced with a series of switches SWA-SWH and current sources I1-I8, or resistors R1-R8. Multiple circuit branches are used instead of just one, because the value of the capacitor C can vary, and it is possible that comparator delay can prevent comparator 40 from reacting quick enough to stop charging a particular capacitor with a particularly fast charging rate. For an ideal comparator with zero delay, the charging current from one current source could be set sufficiently large enough to charge the expected maximum-sized capacitor in the maximum allowable time. In that ideal case any smaller capacitance would just be charged faster. A non-ideal comparator does have some delay, and an error in final voltage could occur if a smaller capacitance capacitor is charged with a large charging current.

The error in final voltage is equal to the charging rate multiplied by the comparator delay. All comparators have some amount of delay and even a small delay can cause a large overshoot in voltage for very fast charging rates. Thus, for a wide variation in capacitance values, the switching of several incremental steps in current is required. Variations in capacitance values resulting from process variations during the fabrication of the capacitor can change the capacitor nominal value by 20-50%. The adaptive capacitor charge/discharge network 10 embodying the present invention accommodates changes in capacitance that are orders of magnitude in variation. For example, a circuit designer may not know the value of capacitor C necessary for a particular application beforehand, but what is known by the circuit designer is the required voltage level of capacitor C at particular times. The adaptive capacitor charge/discharge network 10 permits the designer to allow the capacitor value to range over several orders of magnitude, while still being able to precisely set the charge level at the proper time.

Accordingly, in an embodiment of the present invention, first a small amount of current is provided by the adaptive capacitor charge/discharge network 10. After some amount of delay a larger amount of current is added, and the current is stepped up at predetermined time intervals until the comparator 40 determines that the capacitor C is charged and turns all of the switches off. If a small capacitor is connected to the network and it is designed appropriately, that capacitor will be fully charged by one of the first (smallest) current sources activated and the circuit will turn off before a large current step is applied. If the capacitor is large however, the first few steps will not charge the capacitor very much in a short period of time, and the later (larger) steps will be needed to be switched in to the circuit.

It should be readily understood by persons of ordinary skill in the art that this staging process does result in a longer period of time to charge up larger capacitors, but it ensures that the error due to comparator delay is controlled. By predetermining the magnitude of the currents, and predetermining the delay time between each switch closing, an optimum sequence for a particular range of capacitor values can be constructed. In other words, the current source and the timing of switching in the current source is predetermined to create a tailored charge/discharge profile.

After switch SWA is closed, capacitor C begins to charge. If the capacitance voltage Vc remains below Vref for the predetermined time, switch SWB is closed, and the charge current is increased. If Vc does not reach Vref within the second predetermined time, switch SWC is closed. Operation of switch SWD follows suit. The adaptive capacitor charge/discharge network 10 also controls the discharge rate of capacitor C in like fashion by opening switches SWA-SWD, and closing switches SWE-SWH.

The comparator delay, the capacitance range and other parameters impacting the charging rate, as discussed above, also impact the control of the capacitor's discharge rate. The considerations for operation during the charge cycle are equally applicable for operation during the discharge cycle of the capacitor.

Figure 3:
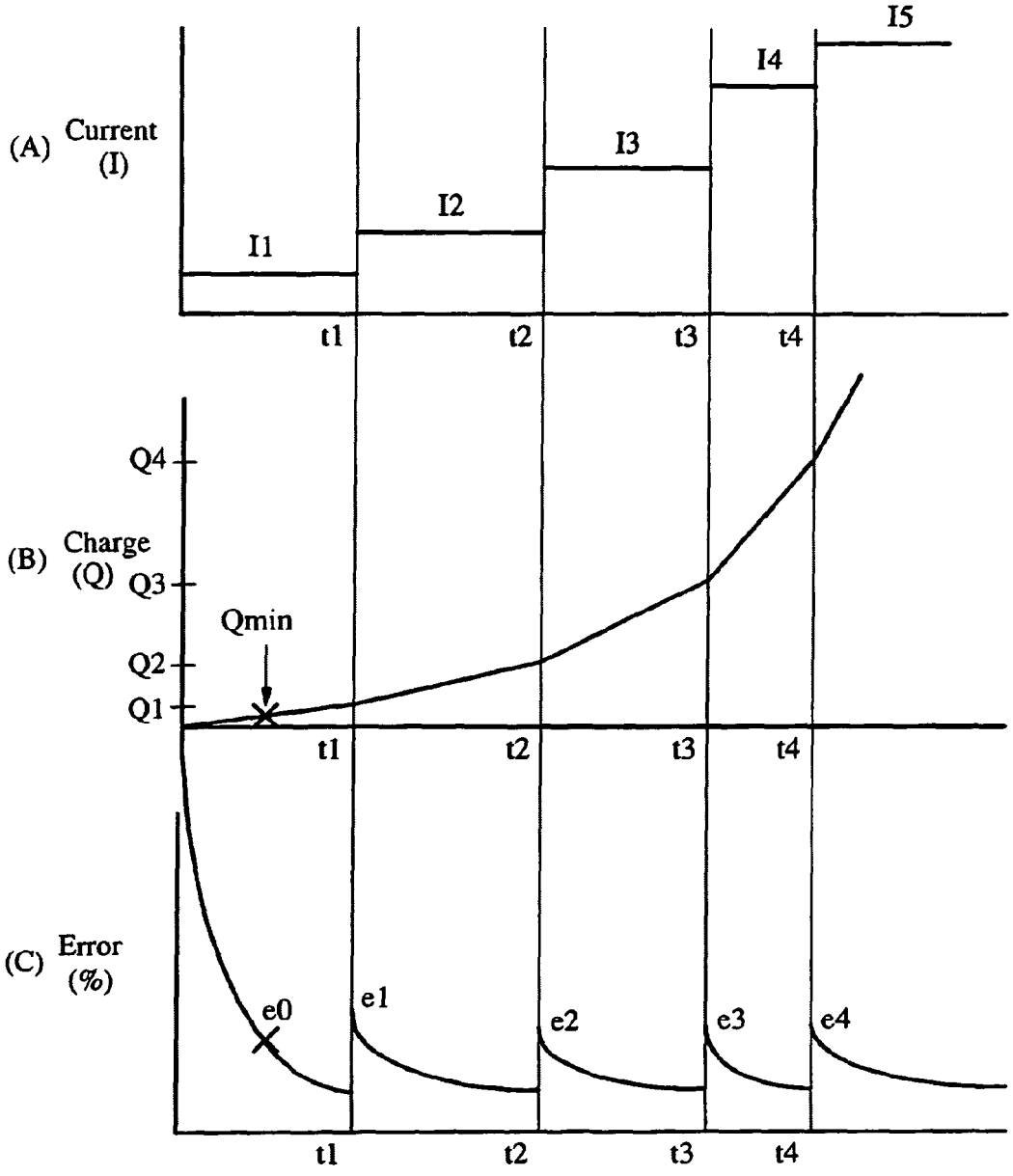
FIG. 3A graphically illustrates a current versus time curve for the capacitor adaptive charge/discharge network.
FIG. 3B graphically illustrates an accumulated charge versus time curve for the capacitor adaptive charge/discharge network.
FIG. 3C graphically illustrates an error versus time curve for the capacitor adaptive charge/discharge network.

The desired charging time and the accuracy are two of the factors that dictate the design of the adaptive capacitor charge/discharge network 10. One or the other of these, or other, factors can be more important for a particular application, system, circuit, or allowable range of capacitor. FIGS. 3A, 3B and 3C, respectively graphically illustrate a current-versus-time curve, an accumulated charge-versus-time curve, and an error-versus-time curve for the adaptive capacitor charge/discharge network 10.

The graph of charge versus time is useful in determining the total amount of time needed to charge the maximum sized capacitor. The point at which the needed amount of charge is reached can be found from this curve. The amount of charge contributed in each stage depends on the current and the delay time between stages. Both the current and delay time can be tailored to suit the particular application.

The error due to delay in the comparator is an inverse function of time starting at each current step. The worst inverse function occurs from the time between 0 and tI. The worst percentage error occurs when charging a small amount because the amount of overshoot can be close to the desired voltage level. The true worst-case error for this time period occurs at the time when the minimum charge Qmin needed to charge the minimum sized capacitor to the minimum reference voltage level is reached. The succeeding errors are a function of the comparator delay time, the switch delays, and the current ratio between the circuit branch stages. It should be noted that the percent error for a particular time depicted in FIG. 3C assumes that the final reference voltage is achieved at the time point for the corresponding charge Q1-Q4 indicated in FIG. 3B.

FIG. 4 depicts Table I, which presents mathematical expressions for selected points of the graphical illustrations of FIGS. 3A-3C. A special simple case occurs when the delay time between switches is a constant. In that case the worst-case error for each stage can be made constant by appropriately sizing the ratios between stages. FIG. 5 depicts Table II, which presents the constraining equations for the worst-case error. Table 2 shows the constraining equations for this scenario. The current for current source I1 can be chosen based on the amount of error allowable in the first stage.

A uniform delay time between stages and the ratio between stages can be chosen by selecting the delay time and the number of stages based on the maximum Q needed to charge the largest capacitor. Alternatively, a simple realizable ratio can be chosen first and the delay time back-calculated. A simple current ratio to achieve is a factor of two. One way to achieve this is to set I2/I1 equal to one. Thus, the second stage current is identical to the first stage current and then all of the succeeding stages increase by a factor of two. This is the equivalent of having twice as much delay on the first stage and increasing the delay of succeeding stages by a factor of two for each subsequent stage. In accordance with this simplification, the Q needed for the largest capacitor determines the number of stages, which then determines the total charging time.

Figure 6:
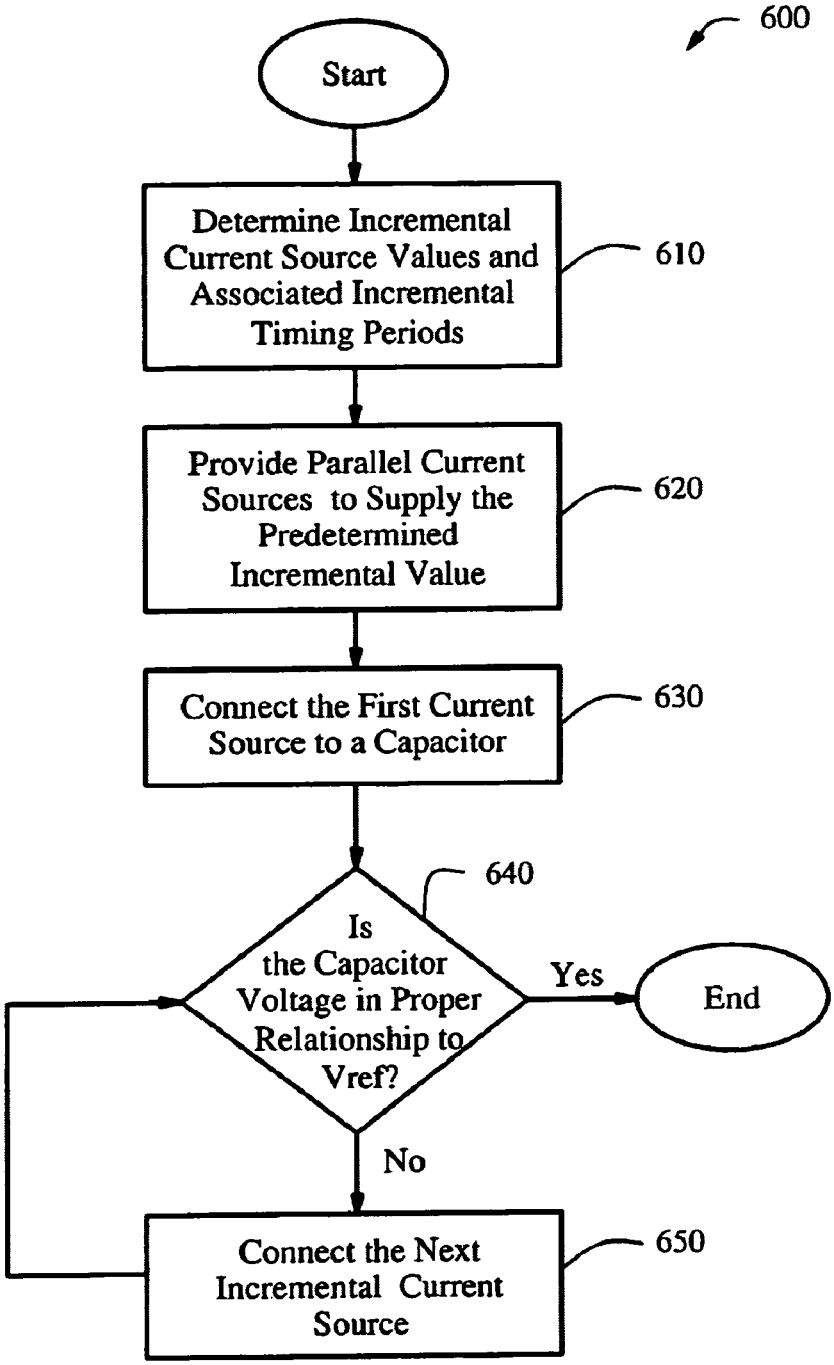
FIG. 6 is a flow diagram illustrating steps in accordance with an illustrated embodiment.

FIG. 6 is a flow diagram for process 600 in accordance with an embodiment of the invention. Process 600 creates a tailored rate-of-change for capacitor C by determining in advance, and controlling, the incremental current values and timing periods of the capacitor charge/discharge cycles. At step 610, the incremental current values to obtain a charge value Q at a specified time (relative to the capacitor's quiescent state) are predetermined. The predetermined incremental current values and associated specified time periods are based on the desired tailored charge/discharge curve for the capacitor in the particular application, system or circuit. The incremental current sources are provided, step 620, in parallel configuration with series switches and connected to the capacitor. Possible configurations for the circuitry include the illustrative embodiments described above. At step 630, the first incremental current source is connected to the capacitor and the capacitor voltage is monitored for the time period associated with the current source. If the capacitor voltage is at the desired level before or at the expiration of the time period, no further action is required. If the capacitor charge is not in proper relationship to Vref (i.e., is the capacitor voltage above or below Vref, depending on whether the capacitor is being charged or discharged), step 640, additional tailoring is required. The next incremental current source is connected to the capacitor, step 650. Process 600 then repeats to step 640, where a determination of the capacitor voltage is again made.

Thus, while there have been shown, described, and pointed out fundamental novel features of the invention as applied to several embodiments, it will be understood that various omissions, substitutions, and changes in the form and details of the devices illustrated, and in their operation, may be made by those skilled in the art without departing from the spirit and scope of the invention. Substitutions of elements from one described embodiment to another are also fully intended and contemplated. It is also to be understood that the drawings are not necessarily drawn to scale, but that they are merely conceptual in nature. The invention is defined solely with regard to the claims appended hereto, and equivalents of the recitations therein.

We claim:

1. A system for tailoring a rate-of-change of a capacitor voltage across a capacitor, the system comprising:

a first circuit group including at least two parallel circuit branches in series with a first voltage source and a first plate of the capacitor, each parallel circuit branch including a current source and a switch connected in series, each of the current sources configured to supply a different amount of current than the other current sources;

a second voltage source in electrical connection with a second plate of the capacitor; and a control circuit configured to receive a voltage reference and to monitor the capacitor voltage;

wherein the control circuit is configured to control closure of the switches in the first circuit group in accordance with a specified timing scheme and in a specified order based on the monitoring of the capacitor voltage so as to achieve a first rate-of-change in the capacitor voltage; and wherein the specified order starts with closure of the switch in series with the current source providing a smallest amount of current and moves in order of increasing current to closure of the switch in series with the current source providing a largest amount of current, each closed switch remaining closed as a next switch in the order is closed.

2. The system of claim 1, wherein the timing scheme includes at least three time periods, wherein a duration of at least two of the time periods is predetermined.

3. The system of claim 1, wherein each current source is one of: a fabricated constant current source, a transistor-biased current source, a current-limiting resistor and a circuit replaceable with a Norton equivalent circuit.

4. The system of claim 1, wherein the control circuit is further configured to open the switches of the parallel circuit branches when the capacitor voltage is relatively equivalent to a level that is based at least in part on the first rate-of-change.

5. The system of claim 1, wherein:

the timing scheme includes at least five time periods;

a duration of at least four of the time periods is predetermined;

for each of the switches of the first circuit group, a status of whether the switch is substantially open or closed during each of the five time periods is predetermined;

the status of at least one switch of the first circuit group is different for each of the five time periods;

the rate-of-change in the capacitor voltage during a third time of the periods is greater than the rate-of-change in the capacitor voltage during a second of the time periods;

the rate-of-change in the capacitor voltage during a fourth of the time periods is greater than the rate-of-change in the capacitor voltage during the third time period;

the rate-of-change in the capacitor voltage during a fifth of the time periods is greater than the rate-of-change in the capacitor voltage during the fourth time period, the second time period precedes the third time period, the third time period precedes the fourth time period, and the fourth time period precedes the fifth time period.

6. The system of claim 1, further comprising:

a second circuit group including at least two second parallel circuit branches in series with the second voltage source and the first plate of the capacitor, each second parallel circuit branch including a second current source and a second switch connected in series;

wherein the control circuit is further configured to control closure of the switches in the second circuit group in accordance with a second specified timing scheme and in a second specified order so as to achieve a second rate-of-change in the capacitor voltage.

7. The system of claim 2, wherein the rate-of-change in the capacitor voltage during a third of the time periods is greater than the rate-of-change in the capacitor voltage during a second of the time periods, and wherein the second time period precedes the third time period.

8. The system of claim 6, wherein the first rate-of-change and the second rate-of-change have a same absolute magnitude as a function of time.

9. The system of claim 6, wherein the first rate-of-change tailors a charge current of the capacitor and the second rate-of-change tailors a discharge current of the capacitor.

10. An adaptive charge/discharge network comprising:

a first circuit group including at least two first parallel circuit branches in series with a first voltage source and a first plate of a capacitor, each first parallel circuit branch including a first current source and a first switch connected in series, each of the first current sources configured to supply a different amount of first current than the other first current sources;

a second circuit group including at least two second parallel circuit branches in series with a second voltage source and the first plate of the capacitor, each second parallel circuit branch including a second current source and a second switch connected in series, each of the second current sources configured to supply a different amount of second current than the other second current sources, a second plate of the capacitor in electrical connection with one of the first and second voltage sources; and a control circuit configured to receive a voltage reference and to monitor a capacitor voltage across the capacitor;

wherein the control circuit is configured to control closure of the switches in the first and second circuit groups in accordance with respective first and second specified timing schemes and in respective first and second specified orders based on the monitoring of the capacitor voltage so as to achieve a specified charge rate in the capacitor voltage and a specified discharge rate in the capacitor voltage;

wherein the first specified order starts with closure of the switch in series with the first current source providing a smallest amount of first current and moves in order of increasing current to closure of the switch in series with the first current source providing a largest amount of first current, each closed switch remaining closed as a next switch in the order is closed; and wherein the second specified order starts with closure of the switch in series with the second current source providing a smallest amount of second current and moves in order of increasing current to closure of the switch in series with the second current source providing a largest amount of second current, each closed switch remaining closed as a next switch in the order is closed.

11. The adaptive charge/discharge network of claim 10, wherein the charge rate and the discharge rate have a same absolute magnitude as a function of time.

12. The adaptive charge/discharge network of claim 10, wherein each of the first and second current sources is one of: a fabricated constant current source, a transistor-biased current source, a current-limiting resistor and a circuit replaceable with a Norton equivalent circuit.

13. The system of claim 10, further comprising:

an enable circuit that is configured to receive a first fault indicator signal and a second fault indicator signal;

wherein opening and closing of the switch in at least one of the parallel circuit branches of the first circuit group is based, at least in part, on the first fault indicator signal; and wherein opening and closing of the switch in at least one of the parallel circuit branches of the second circuit group is based, at least in part, on the second fault indicator signal.

14. The adaptive charge/discharge network of claim 10, wherein:

the first timing scheme includes at least three first time periods, wherein a duration of at least two of the first time periods is predetermined; and the second timing scheme includes at least three second time periods, wherein a duration of at least two of the second time periods is predetermined.

15. A method of tailoring a rate-of-change in a capacitor voltage across a capacitor, the method comprising the steps of:

connecting a first incremental current source to the capacitor;

monitoring the capacitor voltage across the capacitor;

if the capacitor voltage is not in proper relationship to a voltage reference after a specified time period, adjusting the capacitor voltage by connecting one or more additional incremental current sources to the capacitor based at least in part on the rate-of-change and the capacitor voltage, and continuing the monitoring of the capacitor voltage; and floating a charging voltage provided to the capacitor when the voltage reference and the capacitor voltage are in the proper relationship;

wherein each additional incremental current source provides a larger amount of current than an immediately-preceding additional incremental current source, and each additional incremental current source remains connected to the capacitor as subsequent additional incremental current sources are connected to the capacitor.

16. The method of claim 15, wherein the rate-of-change controls a charge current to the capacitor.

17. The method of claim 15, wherein the rate-of-change controls a discharge current from the capacitor.

18. The method of claim 15, wherein the current sources achieve a pre-selected charge curve rate-of-change or a pre-selected discharge curve rate-of-change.

19. The method of claim 18, wherein the current sources are configured to provide current of incrementally increasing value, and a specified order associated with the current sources connects the current source providing a smallest amount of current to the capacitor first.

20. The method of claim 19, wherein the current sources are coupled to the capacitor using a timing scheme that includes at least three time periods, wherein a duration of at least two of the time periods is predetermined.

21. The system of claim 13, wherein the enable circuit includes:

a first AND gate configured to receive the first fault indicator signal as a first input and to receive a second input from the control circuit, wherein the first AND gate is configured to control the closure of the switch in at least one of the parallel circuit branches of the first circuit group;

an inverter configured to receive an input from the control circuit and to provide an inverted output signal; and a second AND gate configured to receive the second fault indicator signal as a first input and to receive a second input from the inverter, wherein the second AND gate is configured to control the closure of the switch in at least one of the parallel circuit branches of the second circuit group.

22. The adaptive charge/discharge network of claim 14, wherein:

the charge rate of the capacitor voltage is larger in a third of the first time periods than in a second of the first time periods; and the discharge rate of the capacitor voltage is larger in a third of the second time periods than in a second of the second time periods.

* * * * *